US011304465B2

(12) United States Patent
Green, II

(10) Patent No.: US 11,304,465 B2
(45) Date of Patent: Apr. 19, 2022

(54) SUN PROTECTIVE BODY BARRIER

(71) Applicant: Henry L Green, II, Wichita, KS (US)

(72) Inventor: Henry L Green, II, Wichita, KS (US)

( * ) Notice: Subject to any disclaimer, the term of this patent is extended or adjusted under 35 U.S.C. 154(b) by 0 days.

(21) Appl. No.: 17/091,073

(22) Filed: Nov. 6, 2020

(65) Prior Publication Data

US 2021/0267290 A1 Sep. 2, 2021

Related U.S. Application Data

(63) Continuation-in-part of application No. 16/805,747, filed on Feb. 29, 2020.

(51) Int. Cl.
*A41D 13/08* (2006.01)
*A41D 19/015* (2006.01)

(52) U.S. Cl.
CPC ..... *A41D 19/0157* (2013.01); *A41D 2400/26* (2013.01)

(58) Field of Classification Search
CPC .. A41D 13/08; A41D 2400/26; A41D 13/084; A41D 27/10; A41D 13/005; A41D 13/0053; A41D 13/088; A41D 19/0006; A41D 19/0041; A41D 19/01; A41D 19/01529; A41D 2400/38; A41D 31/02; A41D 19/0044; A41D 19/0048; A41B 7/02; B60J 1/2091; B60J 3/0286
See application file for complete search history.

(56) References Cited

U.S. PATENT DOCUMENTS 214,796 A * 4/1879 Thompson ..... A41D 13/08 2/16
632,547 A * 9/1899 Barth ..... A41D 19/01 2/158
925,952 A * 6/1909 Sacks ..... A41D 13/08 2/59
1,117,077 A * 11/1914 Mooney ..... A41D 13/08 2/16
1,796,782 A * 3/1931 Gasperini ..... A41D 13/08 2/87
2,205,957 A * 6/1940 Kinkis ..... A41D 13/082 2/20
4,261,649 A * 4/1981 Richard ..... B60J 3/0286 296/97.2
4,785,478 A * 11/1988 Mosley ..... A41D 13/084 2/161.6
5,056,157 A * 10/1991 Pryor ..... A41D 13/08 2/16
5,125,115 A * 6/1992 Lincoln ..... A41D 13/084 2/159
5,435,012 A * 7/1995 Lincoln ..... A41D 13/084 2/159
5,628,062 A * 5/1997 Tseng ..... A41D 13/08 2/16

(Continued)

*Primary Examiner* — Robert H Muromoto, Jr.

(57) ABSTRACT

The sun protective body barrier is useful for protecting a left arm and hand against ultra-violet radiation while driving a motor vehicle. Also, the sun protective body barrier is inexpensive and reusable while also adjusting to the width and length of a user's left arm and hand. Further, the sun protective body barrier is useful for reducing the effect of the sun's rays while driving that is quick, easy and effective. The sun protective body barrier has removable a sleeve and a hand cover that protect the hand and arm from the UV rays of the sun.

18 Claims, 5 Drawing Sheets

(56) References Cited

U.S. PATENT DOCUMENTS 5,911,309 A * 6/1999 Penney ..... A41D 19/01505 2/16
6,507,413 B1 * 1/2003 Mueller ..... B41J 3/407 358/1.9
6,585,311 B2 * 7/2003 Farrar ..... B60J 1/2094 296/146.1
6,688,044 B2 * 2/2004 Farrar ..... B60J 1/2094 49/375
6,705,381 B2 * 3/2004 Huang ..... B60J 1/2091 160/370.22
6,748,599 B1 * 6/2004 Farady ..... A41D 13/084 2/16
6,871,902 B2 * 3/2005 Carson ..... B60J 1/2094 296/146.15
6,952,838 B1 * 10/2005 Gillette ..... A41D 15/002 2/159
7,021,006 B2 * 4/2006 Farrar ..... B60J 1/2094 49/375
7,080,874 B2 * 7/2006 Farrar ..... B60J 1/007 296/146.15
7,193,631 B2 * 3/2007 Mueller ..... B41J 3/407 345/592
7,210,655 B2 * 5/2007 Novak ..... B64C 1/066 244/119
7,254,927 B1 * 8/2007 Farrar ..... B60J 1/2094 52/741.1
7,297,400 B2 * 11/2007 Yang ..... C08F 290/061 428/345
7,791,562 B2 * 9/2010 Mueller ..... B44C 1/17 345/55
7,927,703 B2 * 4/2011 Xia ..... B32B 7/12 428/412
8,757,249 B2 * 6/2014 Bandai ..... B60H 1/244 165/202
D715,496 S * 10/2014 Hain ..... D29/117.1
9,085,930 B2 * 7/2015 Steiner ..... E06B 9/24
9,162,553 B2 * 10/2015 Benites ..... B60J 1/20
9,345,277 B2 * 5/2016 Albera ..... A45D 29/00
9,820,516 B2 * 11/2017 Ferrer ..... A41D 13/084
9,894,944 B2 * 2/2018 Brooks ..... A41D 13/0053
10,076,144 B2 * 9/2018 Rivera ..... A41D 27/10
10,405,590 B2 * 9/2019 Crayton ..... A41D 19/0041
10,486,503 B2 * 11/2019 Freese ..... B60J 1/2086
10,517,413 B1 * 12/2019 Soucy ..... A47G 9/06
2001/0039673 A1 * 11/2001 Carraway ..... A41D 27/10 2/170
2002/0108726 A1 * 8/2002 Huang ..... B60J 1/2091 160/370.23
2002/0193719 A1 * 12/2002 Yewer, Jr. ..... A61F 5/0118 602/21
2007/0028345 A1 * 2/2007 McCarty ..... A41D 13/08 2/59
2010/0024088 A1 * 2/2010 Griefer ..... A41D 13/08 2/16
2010/0083415 A1 * 4/2010 Beckford ..... A41D 13/08 2/16
2012/0066810 A1 * 3/2012 Marcus ..... A41D 19/0044 2/16
2012/0210501 A1 * 8/2012 Lavin ..... A41D 13/0512 2/468
2016/0327979 A1 * 11/2016 Lettow ..... A41D 31/02
2016/0374411 A1 * 12/2016 Brooks ..... A61F 7/007 165/104.21
2017/0156340 A1 * 6/2017 Toreki ..... D06M 11/46
2017/0231811 A1 * 8/2017 Cubon ..... A61F 7/007 607/110
2018/0338543 A1 * 11/2018 Robertson ..... A41D 27/10

* cited by examiner

SUN PROTECTIVE BODY BARRIER

This utility application is a continuation-in-part application of U.S. patent application Ser. No. 16/805,747, filed on Feb. 29, 2020, the entirety of the application is hereby incorporated by reference.

FIELD OF THE INVENTION

This application relates to motor vehicles. More particularly, it relates to prevention of tanning/sunburns while driving motor vehicles.

BACKGROUND

Driving has reference to the movement of a motor vehicle, including cars, motorcycles, trucks, and buses. Permission to drive on public highways k granted based on a set of conditions being met and drivers are required to follow the established road and traffic laws in the location they are driving.

Sunburn k a form of radiation burn that affects living tissue, such as skin, that results from an overexposure to ultraviolet (UV) radiation, usually from the sun. Common symptoms in humans and other animals include: red or reddish skin that k hot to the touch or painful, general fatigue, and mild dizziness. Excessive UV radiation can be life-threatening in extreme cases. Excessive UV radiation is the leading cause of, primarily, non-malignant skin tumors. Sunburn k an inflammatory response in the tissue triggered by direct DNA damage by UV radiation. When the cells' DNA k overly damaged by UV radiation, type I cell-death k triggered, and the tissue is replaced. Sun protective measures including sunscreen and sun protective clothing are widely accepted to prevent sunburn and some types of skin cancer. Special populations, including children, are especially susceptible to sunburn and protective measures should be used to prevent damage.

Driving, whether by car on a business, vacation or family trip, or by truck as an over the road truck driver, has become more and more common. One problem faced by those who spend a good portion of their workday driving a motor vehicle is that of excessive tanning of the left arm. After years of driving, the tanning becomes noticeable when compared to the right arm.

While this is a cosmetic annoyance in most cases, severe exposure can result in burns and peeling. Long term exposure to ultra-violet (UV) radiation can result in skin cancer as well.

When drivers wear long sleeve shirts, they may become too hot throughout the day. Suntan lotion may be applied but becomes costly over time and many do not like the greasy feeling or the smell.

Accordingly, in light of the foregoing, there exists a need for a means by which drivers of motor vehicles can be provided protection from the sun's rays on their left arm.

DETAILED DESCRIPTION

Figure 1A:
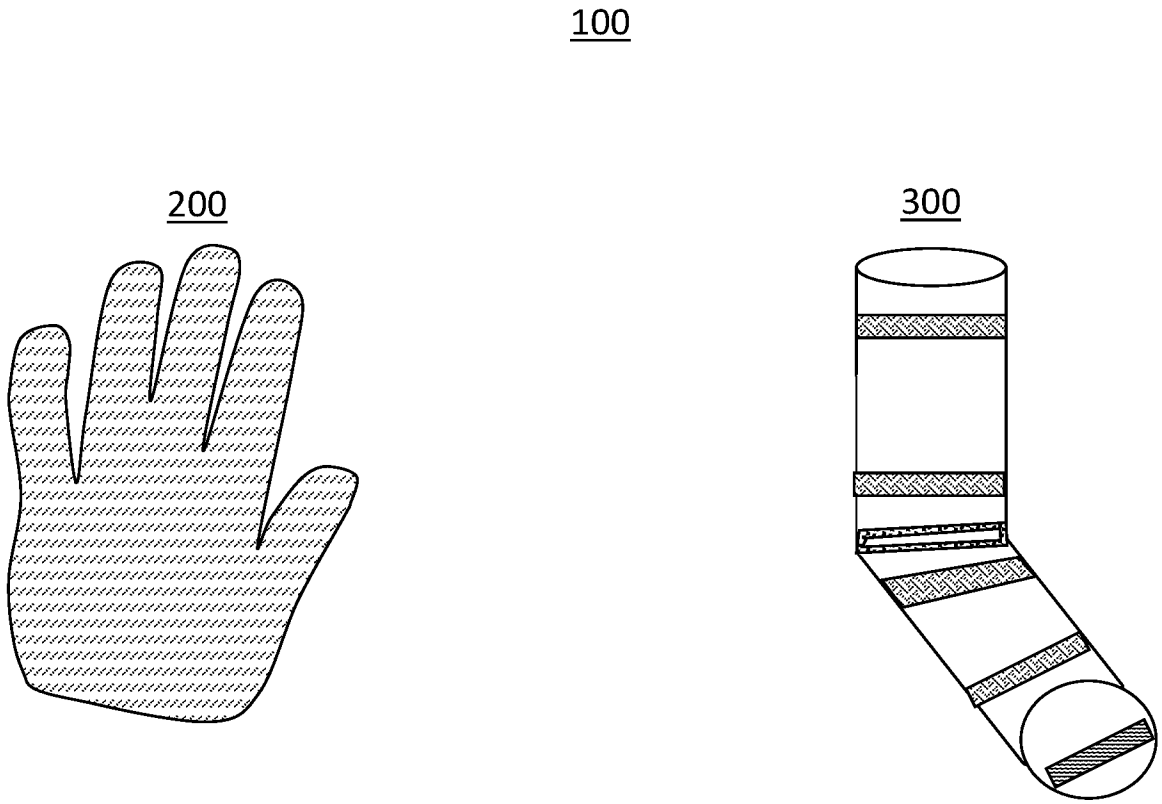
FIG. 1A is an illustrated view of an exemplary sun protective body barrier for a left hand and arm.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Referring to FIG. 1A, an illustrated view of an exemplary sun protective body barrier 100 for protecting a left hand and arm when driving is presented. The sun protective body barrier 100 is useful for protecting a left arm and hand against ultra-violet (UV) radiation while driving a motor vehicle. Also, the sun protective body barrier 100 is inexpensive and reusable while also adjusting to the width and length of a user's left arm and hand. Further, the sun protective body barrier 100 is a quick, easy and effective way of reducing the effect of the sun's rays while driving.

The sun protective body barrier 100 is preferably eight (8) inches in width, however other widths are hereby contemplated, including, but not limited to, seven (7) inches, nine (9) inches, etc. The sub protective body barrier 100 is preferably eighteen (18) inches in length, however other lengths are hereby contemplated, including, but not limited to, seventeen (17) inches, nineteen (19) inches, etc.

The sun protective body barrier 100 has a hand covering 200 and a sleeve 300. The hand covering 200 preferably is configured to be for a left hand of a person. The sleeve 300 is preferably configured to be for a left arm of the person.

The hand covering 200 is preferably made of a mylar material, however other materials are hereby contemplated.

The sleeve 300 is preferably made of a mylar material, however other materials are hereby contemplated. The sleeve 300 is preferably made of reflective material, however non-reflective material is hereby contemplated. The sleeve 300 is preferably silver in color, however other colors are hereby contemplated.

Figure 1B:
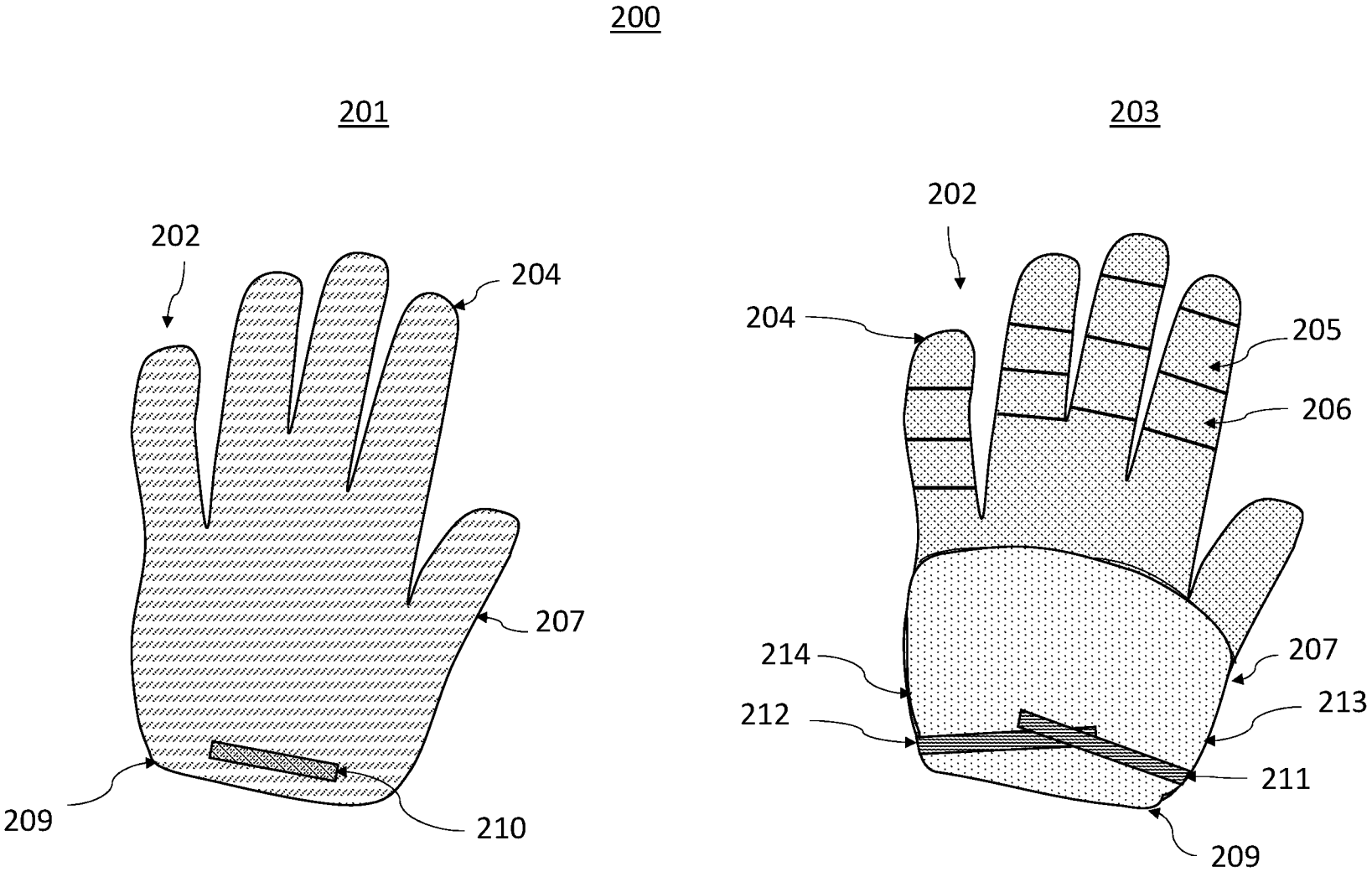
FIG. 1B is an illustrated view of a hand covering of the exemplary sun protective body barrier shown in FIG. 1A.

Referring now to FIG. 1B, an illustrated view of the hand covering 200 of the exemplary sun protective body barrier 100 shown in FIG. 1A. The hand covering 200 has an outside 201, a plurality of fingers 202 and an inside 203.

The outside 201 of the hand covering 200 is preferably made of reflective material, however non-reflective material is hereby contemplated. The outside 201 of the hand covering 200 is preferably silver in color, however other colors are hereby contemplated.

The hand covering 200 has an edge 207 and a bottom 209. The edge 207 of the hand covering 200 is reinforced to enhance the life span of the hand covering 200.

A coupling device 210 is configured to be substantially near the bottom 209 of the outside 201 of the hand covering. The coupling device 210 is preferably a Velcro®-like material.

The inside 203 of the hand covering 200 has a palm 208 and the bottom 209.

A tip 204 of the plurality of fingers 202 of the hand covering 200 are preferably reinforced materials. Other portions of the fingers 205, 206 may be made of reinforced material.

A first of the plurality of strips 211 is coupled to the edge 207 of a first side 213 of the inside 203 of the hand covering 200 substantially near the bottom 209. A second of the plurality of strips 212 is coupled to the edge 207 of a second side 214 of the inside 203 of the hand covering 200 substantially near the bottom 209. To secure the hand covering 200 around a wrist area of a hand, the first of the plurality of strips 211 is coupled to the second of the plurality of strips 212. The plurality of strips 211, 212 are preferably made of a Velcro®-like material.

Figure 1C:
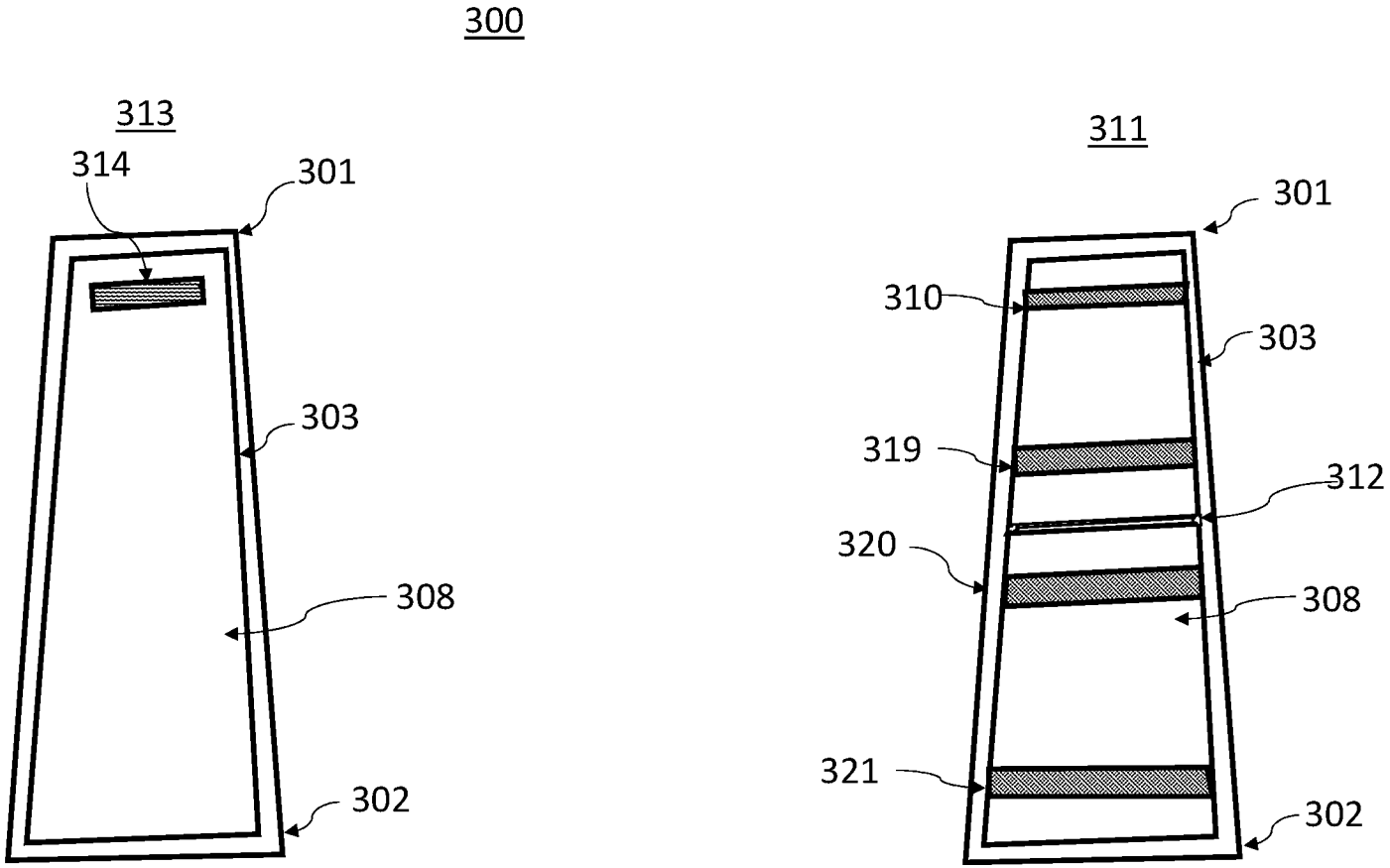
FIG. 1C is an illustrated view of a sleeve of the exemplary sun protective body barrier shown in FIG. 1A.

Moving now to FIG. 1C, an illustrated view of the sleeve 300 of the exemplary sun protective body barrier 100 shown in FIG. 1A.

The sleeve 300 has a top 301, a bottom 302, a border 303 and a middle portion 308. The top 301 of the sleeve 300 is between one and three (1-3) inches in width, however other widths are hereby contemplated, including, but not limited to, one-half (0.5) inch, four (4) inches, etc. The bottom 302 of the sleeve 300 is preferably six (6) inches in width, however other widths are hereby contemplated, including, but not limited to, five and one-half (5.5) inches, seven (7) inches, etc. The sleeve 300 is preferably eighteen (18) inches in length, however other lengths are hereby contemplated, including, but not limited to, seventeen (17) inches, nineteen (19) inches, etc.

The border 303 is preferably reinforced to allow for a longer life of the sun protective body barrier 100. The middle portion 308 of the top 301 of the sleeve 300 is preferably a reflective material, such as mylar.

A plurality of elastic straps 310, 319, 320, 321 are coupled to a first side 311 of the sleeve 300 between the board 303. The plurality of elastic straps 310, 319, 320, 321 are preferably coupled to the first side 311 of the sleeve 300 by stitching, adhesive, etc. The number of elastic straps 310, 319, 320, 321 is preferably four (4), however any number of straps are contemplated.

A first of the elastic straps 310 is configured to be substantially near the top 301 of the first side 311 of the sleeve 300. A second and a third of the elastic straps 319, 320 are configured to be substantially near an elbow area 312 of the first side 311 of the sleeve 300. A fourth of the elastic straps 321 is configured to be substantially near the bottom 302 of the first side 311 of the sleeve 300. The elastic straps 310 are configured to secure the sleeve 300 to a left arm of a person. The plurality of elastic straps 310 are sewn, stitched or coupled by adhesive to the sleeve 300.

A second side 313 of the sleeve 300 further has a coupling device 314. The coupling device 314 is preferably made of a Velcro® material. The coupling device 314 is securely and removably coupled to the coupling device 210 of the outside 201 of the hand covering 200.

Figure 2A:
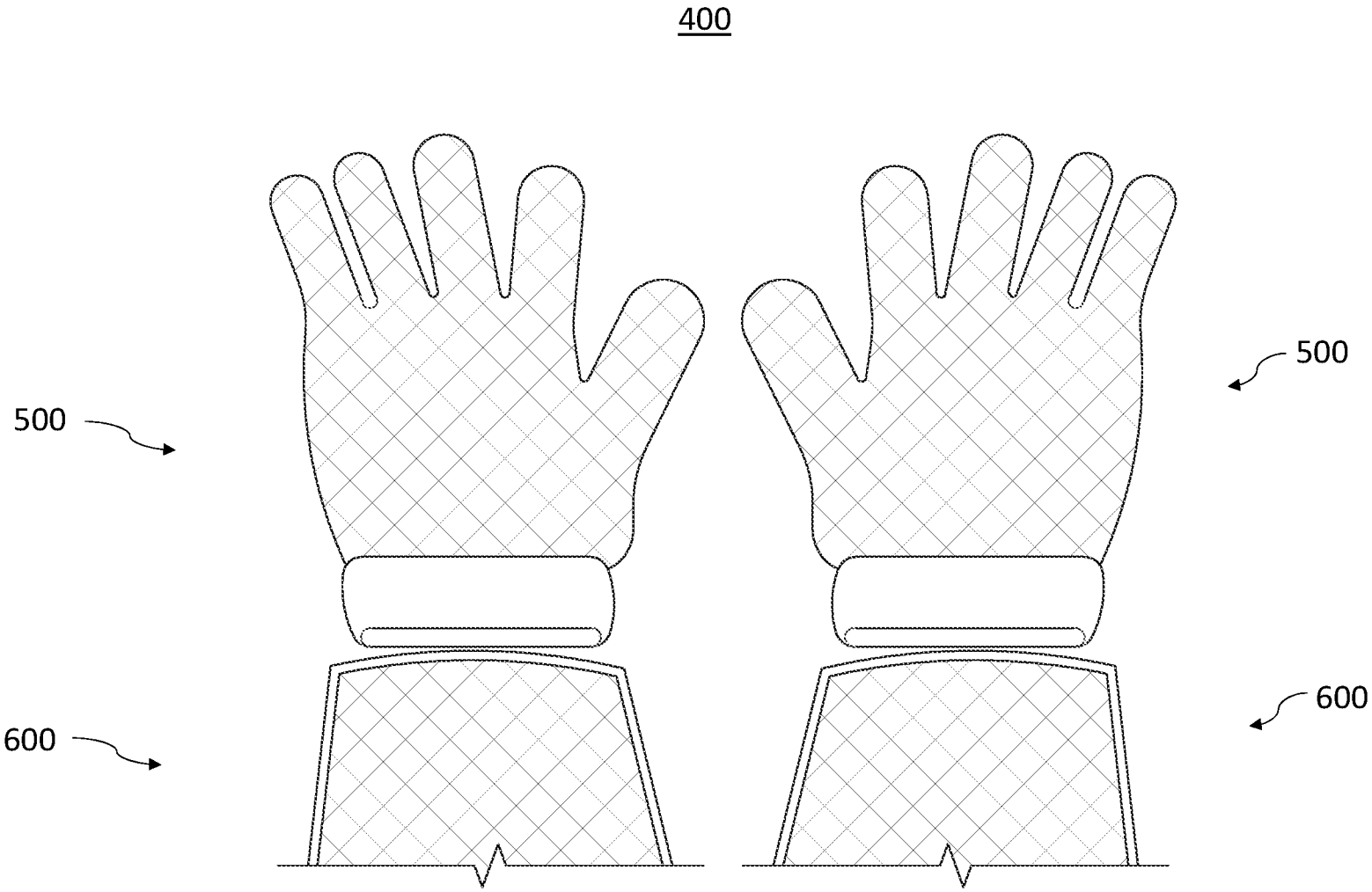
FIG. 2A is an illustrated view of a second embodiment of an exemplary sun protective body barrier.

Referring now to FIG. 2A, an illustrated view of a second embodiment of an exemplary sun protective body barrier 400 for protecting a hand and an arm when driving is presented. The sun protective body barrier 400 is useful for protecting a left arm and hand against ultra-violet (UV) radiation while driving a motor vehicle. Also, the sun protective body barrier 400 is inexpensive and reusable while also adjusting to the width and length of a user's arm and hand. Further, the sun protective body barrier 400 is useful for reducing the effect of the sun's rays while driving.

The sun protective body barrier 400 is preferably eight (8) inches in width, however other widths are hereby contemplated, including, but not limited to, seven (7) inches, nine (9) inches, etc. The sun protective body barrier 400 is preferably eighteen (18) inches in length, however other lengths are hereby contemplated, including, but not limited to, seventeen (17) inches, nineteen (19) inches, etc.

The sun protective body barrier 400 has a hand covering 500 and a sleeve 600. The hand covering 500 preferably is configured to be for a left hand of the person. The sleeve 600 is preferably configured to be for a left arm of the person but may be configured for a right arm of the person.

The hand covering 500 is preferably made of a mylar material, however other materials are hereby contemplated.

The sleeve 600 is preferably made of a mylar material, however other materials are hereby contemplated. The sleeve 600 is preferably made of reflective material, however non-reflective material is hereby contemplated. The sleeve 600 is preferably silver in color, however other colors are hereby contemplated.

Figure 2B:
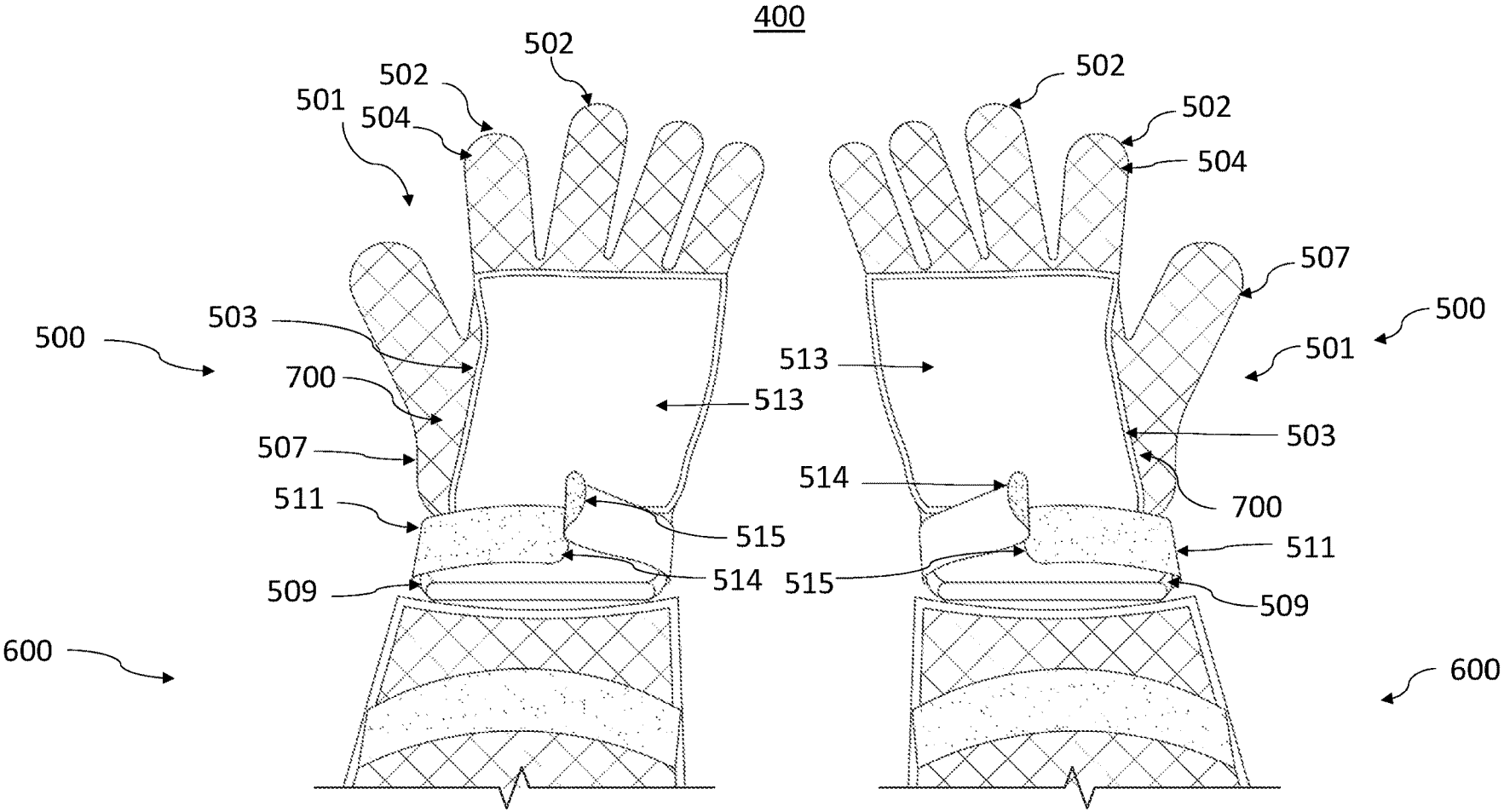
FIG. 2B is an illustrated view of a palm portion of the exemplary sun protective body barrier shown in FIG. 2A.

Moving now to FIG. 2B, an illustrated view of a second embodiment of a palm portion 700 of the sun protective body barrier 400, shown in FIG. 2A is presented.

The hand covering 500 has an outside 501, a plurality of fingers 502, an inside 503 and the palm portion 700.

The outside 501 of the hand covering 500 is preferably made of reflective material, however non-reflective material is hereby contemplated. The outside 501 of the hand covering 500 is preferably silver in color, however other colors are hereby contemplated.

The hand covering 500 has an edge 507 and a bottom 509. The edge 507 of the hand covering 500 is reinforced to enhance the life span of the hand covering 500.

The inside 503 of the hand covering 500 has the palm portion 700 and the bottom 509.

A tip 504 of the plurality of fingers 502 of the hand covering 500 are preferably reinforced materials. Other portions of the fingers 502 may be made of reinforced material.

A strap 511 is coupled to the edge 507 of the hand covering 500 substantially near the bottom 509. To secure the hand covering 500 around a wrist area of a hand, a first end 514 of the strap 511 is coupled to a second end 515 of the strap 511. The first end 514 and the second end 515 of the strap 511 are preferably made of a Velcro®-like material. The first end 514 is pulled tightly to securely couple the hand covering 500 to the hand.

The palm portion 700 is open to view the inside 503 of the hand covering 500. A padding 513 is coupled to the inside 503 of the hand covering 500 such that the hand is protected. The padding 513 is preferably a leather material, however other materials are hereby contemplated, including, but not limited to, felt, suede, etc. The padding 513 is useful for providing a resistance against a steering wheel, not shown, when driving a vehicle or motorcycle.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A sun protective body barrier for protecting a left hand and arm when driving, the sun protective body barrier consisting of:

a hand covering, the hand covering consisting of:

a top;

a plurality of fingers, wherein each of the plurality of fingers having a tip;

an inside, the inside of the hand covering have a palm and a bottom, wherein the inside of the hand covering having a padding, wherein the padding being made of a leather material;

an edge, wherein the edge being around the hand covering; and one or more first straps, wherein each of the first straps being coupled to an edge substantially the bottom of the hand covering, wherein a second end of each of the first straps being coupled to the edge substantially near a bottom of the hand covering; and a sleeve, the sleeve consisting of:

a top, a bottom, a middle portion, an elbow area, an edge and a border, wherein the bottom being coupled to a top of the hand covering by one or more second straps, wherein the sun protective body barrier having a length being eighteen inches wherein the inside of the hand covering having a padding.

2. The sun protective body barrier of claim 1, wherein the top of the sleeve having a width being between one to three inches.

3. The sun protective body barrier of claim 1, wherein the bottom of the sleeve having a width being six inches.

4. The sun protective body barrier of claim 1, wherein the sleeve having a length being eighteen inches.

5. The sun protective body barrier of claim 1, wherein the hand covering being made of a mylar material.

6. The sun protective body barrier of claim 1, wherein the hand covering being made of a reflective material.

7. The sun protective body barrier of claim 1, wherein the border of the hand covering being reinforced.

8. The sun protective body barrier of claim 1, wherein the border of the sleeve being reinforced.

9. The sun protective body barrier of claim 1, wherein the border of the hand covering being reinforced.

10. The sun protective body barrier of claim 1, wherein the plurality of elastic straps being four (4) in number.

11. The sun protective body barrier of claim 1, wherein the plurality of elastic straps being coupled to the first side by stitching.

12. The sun protective body barrier of claim 1, wherein the edge of the hand covering being reinforced.

13. The sun protective barrier of claim 1, wherein the border of the sleeve being reinforced.

14. The sun protective barrier of claim 1, wherein the coupling device of the sleeve configured to being securely and removing coupled to the coupling device of the hand covering.

15. The sun protective barrier of claim 1, wherein the padding being made of a leather material.

16. The sun protective barrier of claim 1, wherein the first end of the strap being made of a hook and loop fastener material.

17. The sun protective barrier of claim 1, wherein the second end of the strap being made of a hook and loop fastener material.

18. A sun protective body barrier for protecting a left hand and arm when driving, the sun protective body barrier consisting of:

a hand covering, the hand covering consisting of:

a plurality of fingers, wherein each of the plurality of fingers having a tip;

an inside, the inside of the hand covering have a palm and a bottom;

an edge, wherein the edge being around the hand covering; and a one or more first straps, wherein each of the first straps being coupled to an edge substantially the bottom of the hand covering, wherein a second end of each of the first straps being coupled to the edge substantially near a bottom of the hand covering, wherein the first straps being a hook and loop fastener, wherein the hand covering being made of a mylar material, wherein the material being reflective, wherein a border of the hand covering being reinforce; and a sleeve, the sleeve having a top, a bottom, a middle portion, an elbow area, an edge and a border, wherein the bottom being coupled to a top of the hand covering by one or more second straps, wherein the straps being a hook and loop fastener, wherein the top having a width between one and three inches; wherein the sun protective body barrier having a length of eighteen inches, wherein the bottom of the sleeve having a width of six inches, wherein the sleeve having a length of eighteen inches, wherein the edge being reinforced, wherein the coupling device of the sleeve configured to be securely and removing coupled to the coupling device of the hand covering.

* * * * *